US007758196B1

(12) United States Patent
He et al.

(10) Patent No.: US 7,758,196 B1
(45) Date of Patent: Jul. 20, 2010

(54) MULTIFUNCTIONAL LIGHTING ELECTRIC FAN

(75) Inventors: Xiangming He, Duruan Town (CN); Guanglian Lin, Duruan Town (CN)

(73) Assignee: Jiangmen Keye Electrical & Mechanical Manufacturing Co., Ltd. (CN)

( * ) Notice: Subject to any disclaimer, the term of this patent is extended or adjusted under 35 U.S.C. 154(b) by 0 days.

(21) Appl. No.: 12/410,770

(22) Filed: Mar. 25, 2009

(51) Int. Cl.
*F21V 33/00* (2006.01)

(52) U.S. Cl. ..... 362/96; 362/253

(58) Field of Classification Search ..... 362/96, 362/253
See application file for complete search history.

(56) References Cited

U.S. PATENT DOCUMENTS 4,665,472 A * 5/1987 Chang ..... 362/294
4,974,126 A * 11/1990 Hwang ..... 362/96
5,287,253 A * 2/1994 Blorstad ..... 362/92
5,603,562 A * 2/1997 Huang ..... 362/96
6,428,185 B1 * 8/2002 Lin ..... 362/253
7,147,336 B1 * 12/2006 Chou ..... 362/96

* cited by examiner

*Primary Examiner*—Laura Tso
(74) *Attorney, Agent, or Firm*—Schmeiser, Olsen & Watts, LLP.

(57) ABSTRACT

The present disclosure relates to the field of ventilation technique. A multifunction lighting electric fan includes a fan body for blowing, a base plate for supporting the fan body and an illuminating device connecting to the fan body. The illuminating device in the present disclosure can be turned freely to change the irradiation direction of the light. The lighting electric fan can both ventilate and light, which satisfy the using needs in the evening. Because the irradiation direction of the lamplight can be adjusted, the lighting electric fan can be used widely and achieve high applicability.

6 Claims, 2 Drawing Sheets

MULTIFUNCTIONAL LIGHTING ELECTRIC FAN

FIELD OF THE INVENTION

The present invention relates to the field of ventilation technique, and particularly to electric fans with lighting function.

BACKGROUND OF THE INVENTION

In the prior art, electric fans are commonly used for ventilation and cooling. In many cases, both ventilating by electric fans and lighting are needed. The common way is to locate an individual light source in the place where lighting is needed, which makes it inconvenient to be operated. What's more, the lighting angle area is basically fixed, which makes it inconvenient to be used.

SUMMARY OF THE INVENTION

The objective of the present invention is to provide a multifunctional lighting electric fan to solve the above-described problems, wherein the multifunctional lighting electric fan can both ventilate and light, which makes it more convenient and more reliable in performance at night. What's more, the lighting direction can be adjusted to achieve a high applicability.

To achieve the abovementioned objective, the present invention provides the following technical solution.

A multifunctional lighting electric fan includes a fan body for blowing and a base plate for supporting the fan body. And the fan body is connected with an illuminating device.

In the present invention, according to a variant protection forms for an blades, said fan body includes a protection shell, a protection net and fan blades housed in the protection shell and the protection net. Said illuminating device is set on the protection shell or the protection net.

According to a variant protection forms for an blades, the fan body in the present invention also can include a protection net and fan blades housed in the protection net, excluding the protection shell. Said illuminating device is set on the protection net.

As an improvement of the above-described technology, an adjusting device connected with the illuminating device is set on the protection shell or the protection network.

As a further improvement of the above-described technology, a bracket for supporting the adjusting device is set on the bottom of the adjusting device. Said bracket is fixedly connected to the protection shell or the protection net. In detail, said adjusting device includes a horizontal rotation adjusting seat and a vertical luffing adjusting seat. The horizontal rotation adjusting seat is movably connected to the lamp. The vertical luffing adjusting seat is fixedly connected to the protection shell or the protection net or the bracket. Said horizontal rotation adjusting seat includes an inverted "U"-shape angle iron which is movably connected to the illuminating device with connecting shaft. Said vertical luffing adjusting seat includes a "U"-shape angle iron which is fixedly connected to the protection shell or the protection net or the bracket. The vertical end of said "U"-shape angle iron is movably connected to the vertical end of said inverted "U"-shape angle iron with a connecting shaft.

According to the above description, it can be known that, the illuminating device can horizontally rotate on the horizontal rotation adjusting seat. In addition, because the horizontal rotation adjusting seat is movably connected to the vertical luffing adjusting seat, the horizontal rotation adjusting seat connected to the lamp can be adjusted pitching angle in vertical with the illuminating device together on the vertical luffing adjusting seat. Thus, the illuminating device can be turned freely through said adjusting device.

Comparing with the prior art, the present invention can achieve the following advantages:

(1) An illuminating device for lighting is connected on the protection shell or the protection net of the electric fan, so that the electric fan can both ventilate and light, and can satisfy the using needs in the evening.

(2) The illuminating device located on the protection shell or the protection net of the electric fan can turn freely. The lighting direction can be adjusted according to the needs. What's more, the illuminating device can be enfolded to be protected when no need of lighting or when transporting, which will make a diminution to the occupation space for storage or transportation.

DETAILED DESCRIPTION OF PREFERRED EMBODIMENTS

The present invention will be described in details with the following embodiments of two types of electric fans of different structures.

The first embodiment is as follows.

Figure 1:
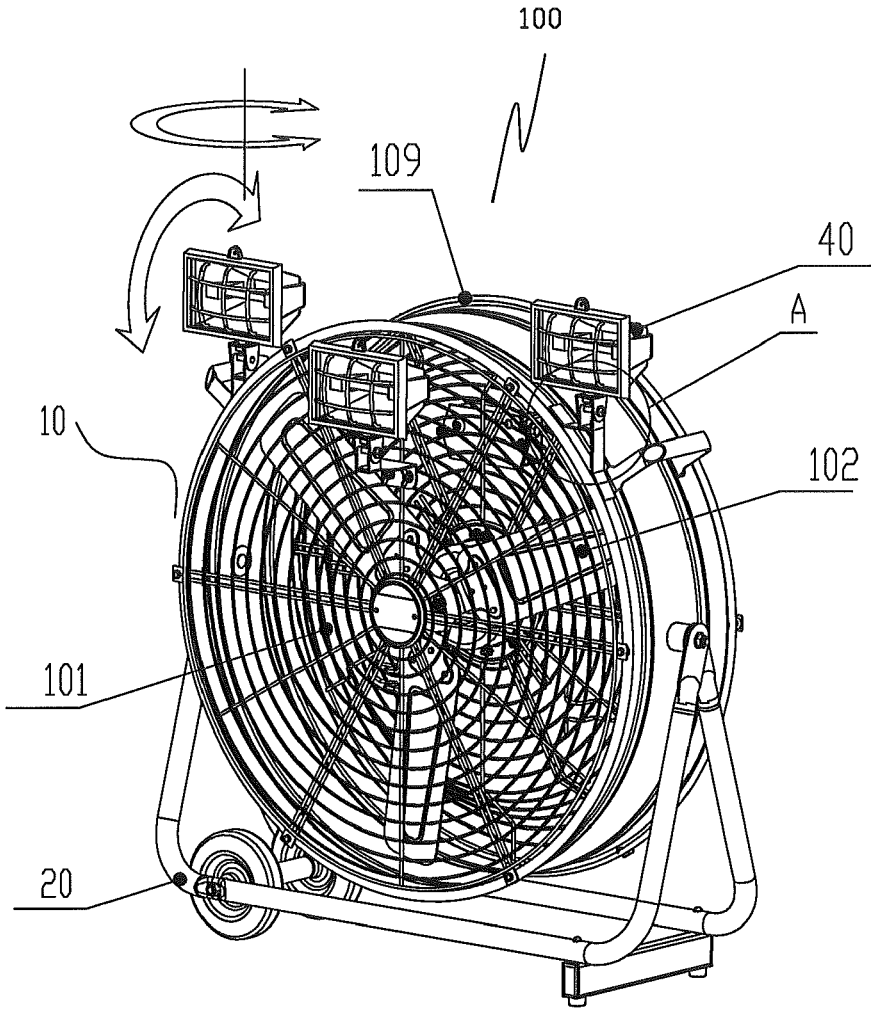
FIG. 1 is a perspective view schematically showing the structure of cylinder multifunctional lighting electric fan according to the first embodiment of the present invention.
Figure 2:
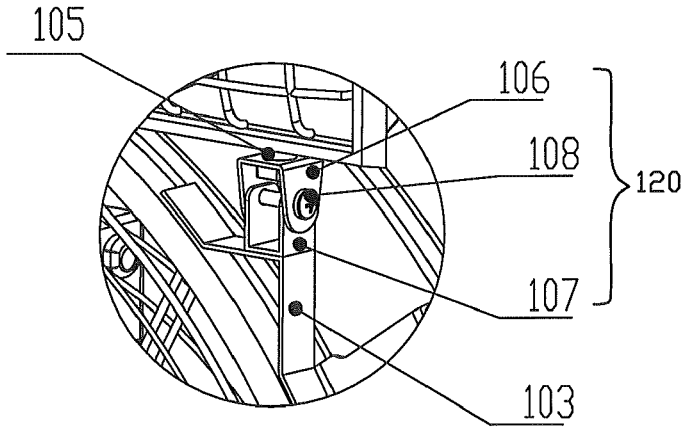
FIG. 2 is an amplified schematic view of part A of the previous said FIG. 1.

Referring to FIG. 1 and FIG. 2, a cylinder multifunctional lighting electric fan 100 according to a first embodiment of the present invention includes a fan body 10, and a base plate 20 for supporting the fan body 10. Said fan body 10 includes a protection shell 109, a protection net 101 and a pluralities of fan blades 102 housed in a space configured by the protection shell 109 and the protection net 101. A bracket 103 is fixedly connected to the protection shell 109 or the protection net 101. An adjusting device 120 is fixedly set on the bracket 103. The lamp 40 is movably connected to the adjusting device 120 and can be turned freely.

In detail, the adjusting device 120 includes an inverted "U"-shape angle iron 106 and a "U"-shape angle iron 107. The inverted "U"-shape angle iron 106 is used as a horizontal rotation adjusting seat, and the "U"-shape angle iron 107 is used as a vertical luffing adjusting seat. The inverted "U"-shape angle iron 106 and the "U"-shape angle iron 107 are movably connected with each other with a connecting shaft 108, making a simple and efficient adjusting device for achieving the turning adjustment of the lamp 40.

The inverted "U"-shape angle iron 106 is movably connected to the lamp 40 with a connecting shaft 105. The "U"-shape angle iron 107 is fixed on the bracket 103. The vertical end of the "U"-shape angle iron 107 is movably jointed to the vertical end of the inverted "U"-shape angle iron 106 with the connecting shaft 108. So that the lamp 40 can be horizontally rotated on the inverted "U"-shape angle iron 106, and the lamp 40 can be adjusted pitching angle in vertical together with the inverted "U"-shape angle iron 106 movably connected to the "U"-shape angle iron 107. So the lamp 40 can be turned freely to adjust the lighting direction.

Said bracket 103 can be removed in the practical application. In this case, the adjusting device 120, which is used for supporting the lamp 40 and adjusting the lighting direction, will be fixedly connected to the protection shell 109 or the protection net 101 directly. That is, the "U"-shape angle iron 107 will be fixed on the protection shell 109 or the protection net 101 directly.

The second embodiment is as follows.

Figure 3:
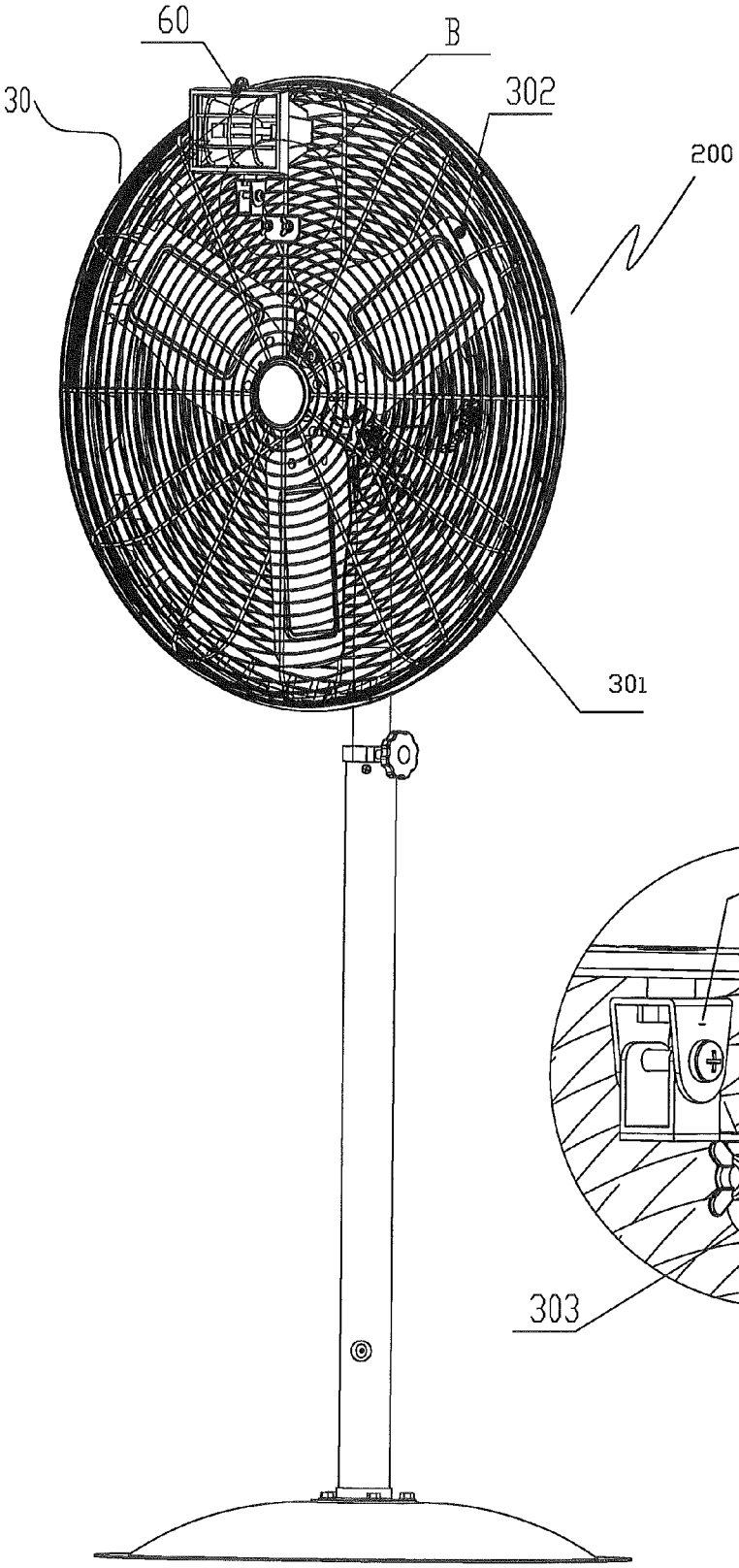
FIG. 3 is a perspective view schematically showing the structure of vertical type multifunctional lighting electric fan according to the second embodiment of the present invention.
Figure 4:
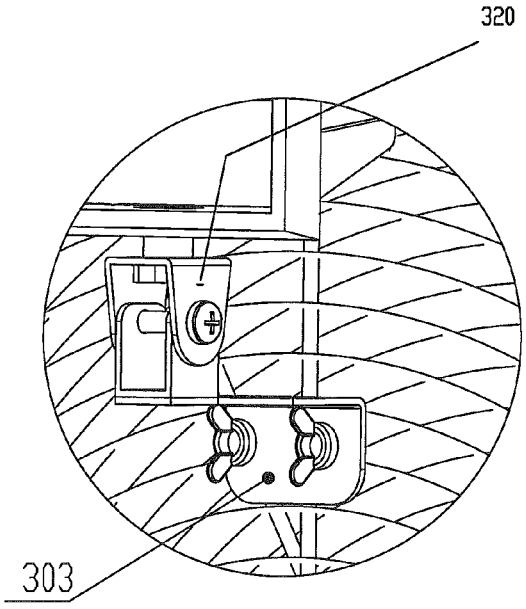
FIG. 4 is an amplified schematic view of part B of the previous said FIG. 3.

Referring to FIG. 3 and FIG. 4, a vertical type multifunctional lighting electric fan 200 according to a second embodiment of the present disclosure is similar to the cylinder multifunctional lighting electric fan 100. However, the fan body 30 includes a protection net 301 and a pluralities of fan blades 302 housed in the protection net 301. The lamp 60 is connected to the protection net 301 or a bracket 303 through the adjusting device 320 as the first embodiment.

The electric fan in present invention can be used in many ventilation technology fields. The lighting function added to the electric fan makes it more conveniently to be used in the evening. User can turn the lamp freely according to the needs, which makes it more widely and practically use.

What is claimed is:

1. A multifunctional lighting electric fan comprising:

a fan body for blowing, which comprises a protection shell, a protection net and fan blades housed in the protection shell and the protection net; and a base plate for supporting the fan body;

an adjusting device, which is located on said protection shell or said protection net; and an illuminating device connected to said adjusting device;

wherein said adjusting device is provided with a bracket supporting the said adjusting device, and said bracket is fixed connected to the protection shell or the protection net.

2. The multifunctional lighting electric fan of claim 1, wherein said adjusting device comprises a horizontal rotation adjusting seat and a vertical luffing adjusting seat, the horizontal rotation adjusting seat is movably connected to the illuminating device, and the vertical luffing adjusting seat is fixedly connected to the protection shell or the protection net or the bracket.

3. The multifunctional lighting electric fan of claim 2, wherein said horizontal rotation adjusting seat comprises an inverted "U"-shape angle iron movably connecting to the illuminating device with a connecting shaft, and said vertical luffing adjusting seat comprises a "U"-shape angle iron fixedly connecting to the protection shell or the protection net or the bracket, and the vertical end of said "U"-shape angle iron is movably connected to the vertical end of said inverted "U"-shape angle iron with a connecting shaft.

4. A multifunctional lighting electric fan comprising:

a fan body for blowing, which comprises a protection net and fan blades housed in the protection net;

a base plate for supporting the fan body;

an adjusting device, which is located on said protection net; and an illuminating device connected to said adjusting device;

wherein said adjusting device is provided with a bracket supporting the said adjusting device, and said bracket is fixed connected to the protection net.

5. The multifunctional lighting electric fan of claim 4, wherein said adjusting device comprises a horizontal rotation adjusting seat and a vertical luffing adjusting seat, the horizontal rotation adjusting seat is movably connected to the illuminating device, and the vertical luffing adjusting seat is fixedly connected to the protection net or the bracket.

6. The multifunctional lighting electric fan of claim 5, wherein said horizontal rotation adjusting seat comprises an inverted "U"-shape angle iron movably connecting to the illuminating device with a connecting shaft, and said vertical luffing adjusting seat comprises a "U"-shape angle iron fixedly connecting to the protection net or the bracket, and the vertical end of said "U"-shape angle iron is movably connected to the vertical end of said inverted "U"-shape angle iron with a connecting shaft.

* * * * *